US006564408B2

(12) United States Patent
Van Vuuren

(10) Patent No.: US 6,564,408 B2
(45) Date of Patent: May 20, 2003

(54) PILLOW FOR SUPPORTING AN INFANT DURING NURSING

(76) Inventor: Shea Van Vuuren, 16038 Black Sheep La., Manchester, MI (US) 48158

( * ) Notice: Subject to any disclaimer, the term of this patent is extended or adjusted under 35 U.S.C. 154(b) by 0 days.

(21) Appl. No.: 09/938,156

(22) Filed: Aug. 23, 2001

(65) Prior Publication Data

US 2002/0023301 A1 Feb. 28, 2002

Related U.S. Application Data

(60) Provisional application No. 60/227,316, filed on Aug. 24, 2000.

(51) Int. Cl.[7] ..... A47C 20/02
(52) U.S. Cl. ..... 5/655; 5/632; 5/731
(58) Field of Search ..... 5/731, 655, 632, 5/652

(56) References Cited

U.S. PATENT DOCUMENTS

| | | | | | |
|---|---|---|---|---|---|
| 1,386,652 | A | | 8/1921 | Patton | |
| 2,281,629 | A | | 5/1942 | Snow | 5/327 |
| 3,606,461 | A | | 9/1971 | Moriyama | 297/445 |
| 4,566,449 | A | | 1/1986 | Smith | 128/133 |
| 4,617,691 | A | | 10/1986 | Monti et al. | 5/434 |
| 4,689,844 | A | | 9/1987 | Alivizatos | 5/455 |
| 4,905,330 | A | * | 3/1990 | Jacobs | 482/23 |
| D309,068 | S | * | 7/1990 | Jordan et al. | 5/655 |
| D318,202 | S | | 7/1991 | Weber | D6/601 |
| 5,029,351 | A | | 7/1991 | Weber | 5/431 |
| 5,035,015 | A | | 7/1991 | Maietta | 5/431 |
| D318,969 | S | | 8/1991 | Byrn | D6/601 |
| 5,133,098 | A | | 7/1992 | Weber | 5/655 |
| 5,154,649 | A | | 10/1992 | Pender | 5/655 |
| 5,360,017 | A | | 11/1994 | Austin | 128/845 |
| 5,551,109 | A | | 9/1996 | Tingley et al. | 5/655 |
| 5,581,833 | A | | 12/1996 | Zenoff | 5/655 |
| 5,647,076 | A | | 7/1997 | Gearhart | 5/631 |
| 5,664,828 | A | | 9/1997 | Simon | 297/153 |
| D393,316 | S | | 4/1998 | Simon | D24/199 |
| 5,790,999 | A | | 8/1998 | Clark | 5/655 |
| 5,800,368 | A | | 9/1998 | Klingemann et al. | 602/1 |
| 5,813,066 | A | | 9/1998 | Gebhard et al. | 5/655 |
| 5,826,287 | A | | 10/1998 | Tandrup | 5/655 |
| 5,963,998 | A | | 10/1999 | Carew et al. | 5/655 |
| 6,061,854 | A | | 5/2000 | Crowley | 5/655 |
| 6,079,067 | A | | 6/2000 | Becker et al. | 5/655 |

* cited by examiner

*Primary Examiner*—Thomas B. Will
*Assistant Examiner*—Lisa M. Saldano
(74) *Attorney, Agent, or Firm*—Gifford, Krass, Groh, Sprinkle, Anderson & Citkowski, P.C.

(57) ABSTRACT

A nursing pillow for supporting an infant on the lap of a user includes a main pillow body having a lower surface and an opposed upper surface interconnected by a front edge, a rear edge and a pair of opposed sides. The pillow body includes a mid portion with a first end and a second end. The upper surface of the mid portion slopes downwardly from side-to-side such that the upper surface of mid portion is higher at the first end and lower at the second end. The pillow body also includes a side portion adjacent the second end of the mid portion. The upper surface of the side portion is raised relative to the second end of the mid portion such that the upper surface of the pillow body steps upwardly from the second end of the mid portion to the side portion.

21 Claims, 3 Drawing Sheets

PILLOW FOR SUPPORTING AN INFANT DURING NURSING

REFERENCE TO RELATED APPLICATION

This application claims priority from U.S. provisional patent application Serial No. 60/227,316, filed Aug. 24, 2000, the entire contents of which are incorporated herein by reference.

FIELD OF THE INVENTION

The present invention relates generally to support pads or pillows and, more specifically, to pillows for supporting infants during nursing.

BACKGROUND OF THE INVENTION

Many mothers prefer to breast feed or nurse an infant. It is believed that mothers' breast milk is more beneficial to an infant than artificial milk formulations or cow's milk. Unfortunately, breast feeding an infant can be both uncomfortable and tiring. The infant must be supported in a position with its head near one breast for an extended period of time. The process may then be repeated with the other breast. Many infants, especially newborns, if supported directly on the lap of the mother, are not properly positioned for nursing. People have resorted to the use of pads and pillows to "boost" the infant into a better position during nursing. Also, a number of pillows or pads have been specifically designed for use during nursing. These pads or pillows typically consist of a cushion with substantially parallel upper and lower surfaces. The pad is placed with the lower surface on the mother's lap and the infant is placed on the upper surface of the cushion. Some designs include a belt or waist strap to hold the front edge of the cushion against the mother's stomach during use. Some pads are also large enough to support more than one infant at a time. However, currently available nursing support pads or pillows do not adequate address the need for supporting an infant during nursing.

SUMMARY OF THE INVENTION

The present invention provides a nursing pillow that improves upon the prior art. In one embodiment, the nursing pillow had a pair of side portions and a mid portion extending between the side portions. The mid portion has an upper surface that slopes downwardly from side-to-side such that an infant supported on the mid portion can be positioned with their head above their abdomen. The side portions preferably have upper surfaces that slope downwardly from the rear side of the pillow to the user side of the pillow for placing an infant in the football-hold nursing position. The lower surface of the mid portion is preferably also sloped such that the pillow may be turned over and the sloped lower surface becomes a sloped upper surface. The sloped upper and lower surfaces are configured such that when the pillow is turned over, the slope extends downwardly in an opposite direction from the non-turned-over position. The pillow preferably includes a supplemental wedge-shaped body that will mate with either the upper or lower surface such that when the supplemental pillow body is combined with the main pillow body, the upper and lower surface is generally flat. Numerous alternatives are also discussed hereinbelow.

DETAILED DESCRIPTION OF THE PREFERRED EMBODIMENTS

Figure 1:
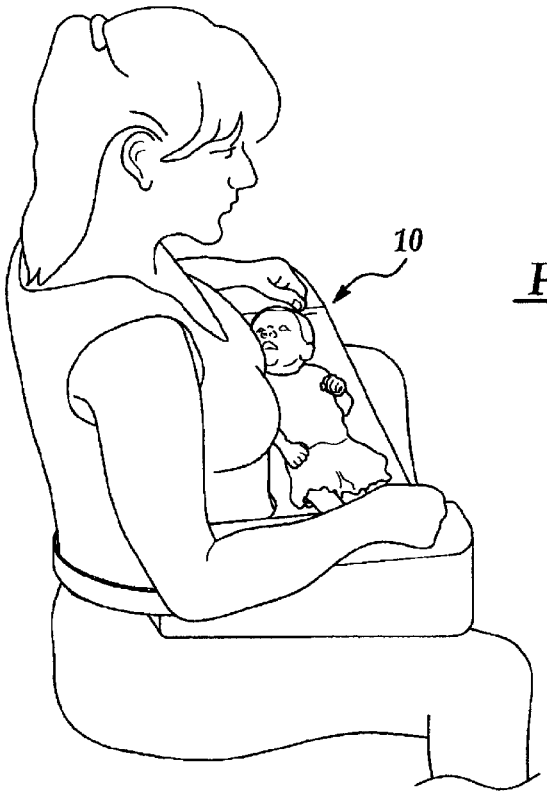
FIG. 1 is a perspective view of a preferred embodiment of a nursing pillow according to the present invention, positioned on the lap of a mother, with an infant resting on the pillow.
Figure 2:
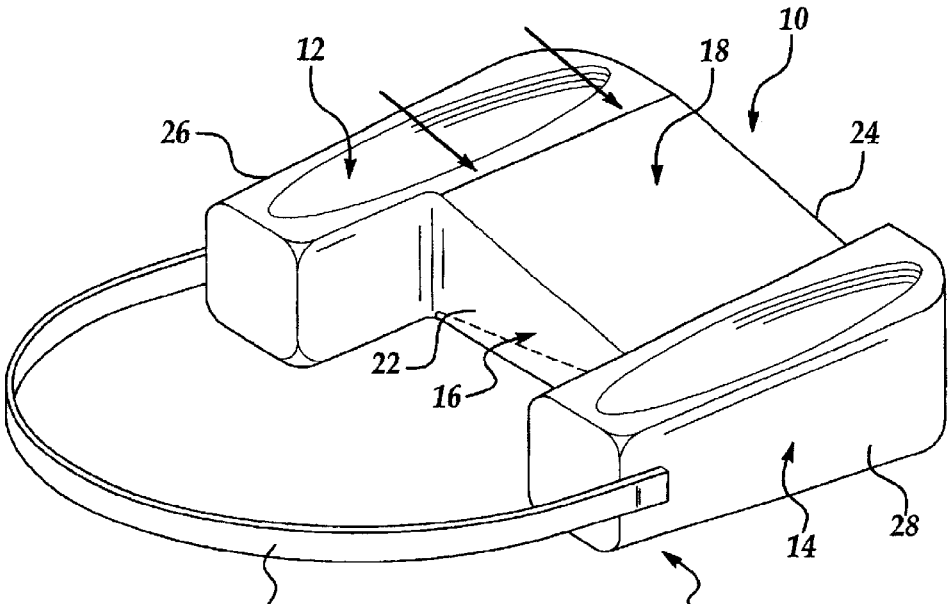
FIG. 2 is a perspective view of a nursing pillow according to the present invention.

Referring to FIGS. 1 and 2, a nursing pillow according to the present invention is generally shown at 10. In FIG. 1, the pillow 10 is shown positioned on a mother's lap with an infant resting on the upper surface of the pillow 10. According to one aspect of the present invention, it is preferred that when nursing an infant, the infant's head is positioned somewhat higher than the infant's abdomen. This positioning makes the infant more comfortable and assists in the nursing process. It is believed that this positioning is healthier for the infant, and leads to less gas and fewer ear infections. It is also preferred that a nursing pillow according to the present invention provide multiple positions for supporting the infant.

Referring now to FIG. 2, the pillow 10 may be said to have a pair of side portions 12 and 14, with a mid-portion 16 extending between the side portions. These portions 12–16 are preferably continuous with one another, with the definition of portions given for ease of discussion. Alternatively, the different portions may be separate pieces that are interconnected. As another alternative, certain embodiments of the present invention may only include the mid portion, or the mid portion and a single side portion. The pillow 10 may also be said to have an upper surface 18 that extends across the upper side of the side portions 12 and 14, as well as the mid portion 16. The pillow 10 also has an opposed lower surface 20. The upper and lower surfaces may be said to be interconnected by a front edge 22, a rear edge 24, and a pair of opposed sides 26 and 28. The front edge 22 is positioned against the stomach of the mother during use, as shown in FIG. 1, with the rear edge 24 facing away from the mother. The sides 26 and 28 extend between the front 22 and rear 24 edges.

Figure 4:
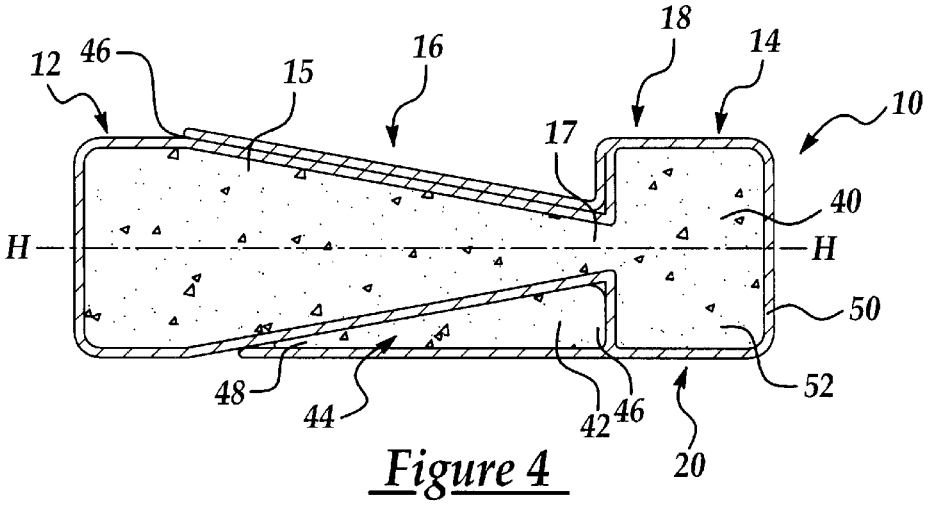
FIG. 4 is a side-to-side vertical cross-sectional view of the pillow of FIG. 2, showing a supplemental pillow nested in a pocket on the lower surface of the main pillow body.

In the illustrated preferred embodiment of the present invention, the mid portion 16 of the pillow 10 has an upper surface that slopes downwardly from side-to-side, as shown. That is, the upper surface of the mid portion 16 is higher where it joins side portion 12 than where it joins side portion 14. This creates a discontinuity or upward step between the lower end of the mid portion 16 adjacent the side portion 14, and the top of the side portion 14. FIG. 4 shows a cross-sectional view of the pillow of FIG. 2, which is constructed according to one of the preferred approaches. As shown, the upper surface slopes downwardly from side-to-side and then steps back up to the side portion. Referring again to FIG. 1, the infant is shown with the head on the higher end of the sloped mid portion 16 and the abdomen and feet positioned lower on the slope. By positioning the infant on the sloped upper surface of the mid portion 16, the infant's head is higher than the abdomen, giving the desired positioning. The slanted surface also preferably keeps the infant's body straighter, which is especially beneficial when the infant is less than 6 months old. The step upward to side portion 14 can be used to prevent the infant from sliding sideways off of the pad. If the infant slides down the sloped mid portion, their feet or rear end come into contact with the upward step and the step acts as a stop or rest.

Referring again to FIG. 4, the pillow 10 may be defined as having a generally horizontal central plane H, with the lower surface 20 being below the plane and the opposed upper surface 18 being above the plane. It should be noted that terms such as horizontal, above, below, downwardly, and upwardly are used only for descriptive convenience, and do not limit the orientation or positioning of the pillow 10. Further, for definitional purposes, the mid portion 16 may be said to have a first end 15 where it joins side portion 12, and a second end 17 where it joins side portion 14. The sloped upper surface of the mid portion 16 is sloped downwardly from side-to-side with respect to the central plane H such that the upper surface is farther from the central plane at the first end 15 and closer to the central plane at the second end 17. In some embodiments of the present invention, the upper surfaces of the side portions 12 and 14 slant downwardly from the rear side 24 to the front side 22. The upper surfaces of each of the side portions may be said to be farther from the central plane towards the rear edge of the pillow and closer to the central plane towards the front edge of the pillow. It should also be noted that the cross-sectional shape of the pillow may be modified somewhat from that shown in FIG. 4. As one example, the step upwardly between the upper surfaces of the second end 17 of the mid portion 16 and the side portion 14 may be shaped different than as shown. For example, the upward step may be other than generally vertical, the transition between the mid portion and the side portion may be more or less rounded, or other changes may be made.

Figure 6:
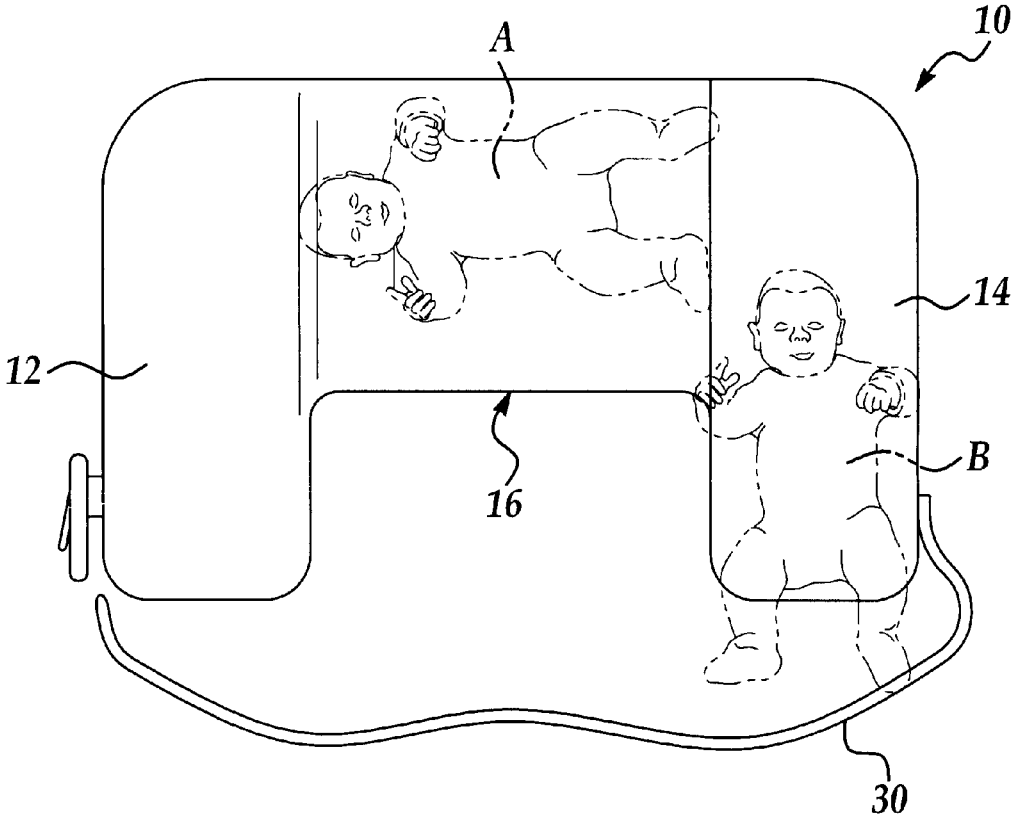
FIG. 6 is a top plan view of the pillow of FIG. 2 showing two possible positions for nursing infants.

Referring now to FIG. 6, a top view of the pillow 10 is shown. Infant A is shown positioned on the mid portion 16 of the pillow 10, in a position similar to the infant in FIG. 1. According to one preferred embodiment of the present invention, the side portions 12 and 14 are wide enough to support an infant in a position perpendicular to the position of infant A. Infant B is shown positioned on side portion 14. Side portion 12 may also be used. The side portions preferably extend frontwardly beyond the front edge of the mid portion, such that they extend partially to the side of the abdomen of the mother when in a use position, as shown in FIG. 1. The side portions may extend as shown, or further or less far. In one embodiment, the side portions extend approximately to the mother's back.

As shown, because the front edges of the side portions 12 and 14 extend farther forwardly than the front edge of the mid portion 16, the pillow 10 has a concave shape to its front edge. The mother's abdomen is preferably positioned in this concavity during use. As will be clear to those of skill in the art, this concavity may be shaped differently, such as more or less curved, or deeper or shallower.

In FIG. 6, infant B is shown on side portion 14 on the extended area. This positioning is sometimes referred to as the football hold for nursing. This places the infant in a position between the abdomen and arm of the mother with the feet and abdomen of the infant extending to the mother's side. The infant B is then positioned for breast feeding from the right breast. Preferably, as best shown in FIG. 2, the upper surface of the side portions 12 and 14 slopes downwardly, with respect to the central plane, from the rear edge 24 to the front edge 22 of the pillow 10. Once again, this positions the head of the infant B above the infant's abdomen. The pillow 10 also allows nursing more than one infant at the same time. The pillow may also be used for bottle feeding on a lap or other surface.

As shown in FIGS. 1, 2 and 6, the pillow 10 preferably includes an attachment strap 30 that is used to secure the front edge 22 of the pillow 10 against the abdomen of the mother. In the illustrated embodiment, one end of the strap 30 is interconnected with the side 28 of side portion 14 and the other end is detachably interconnected with the side 26 of side portion 12. Other configurations may also be used. Also, the strap may include a back pad or bolster for supporting the mother's back during nursing. Referring again to FIGS. 1 and 2, it is preferred that the lower surface 20 of the pillow 10 be generally flat so that it may be easily supported on a mother's lap.

Figure 3:
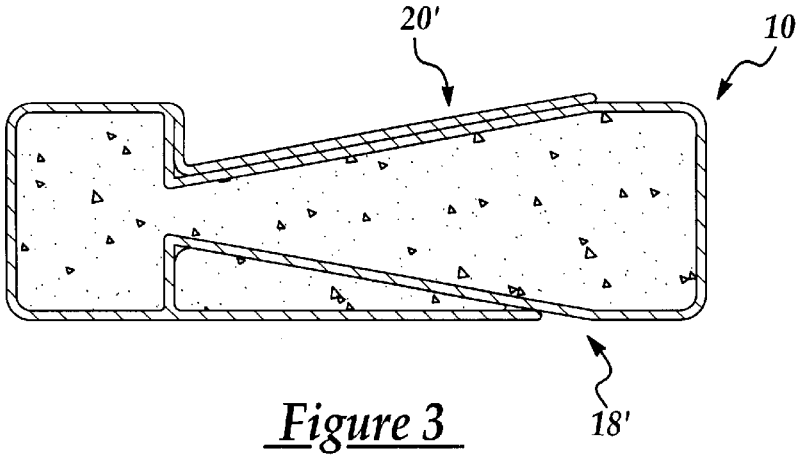
FIG. 3 is a side-to-side vertical cross-sectional view of the pillow of FIG. 2 reconfigured for nursing from the other breast.

As shown in FIG. 1, the configuration just described for the pillow 10 allows positioning of the infant on the mid portion of the pillow 10 so as to nurse from the left breast. However, this configuration does not easily allow the infant to be positioned on the mid portion so as to nurse from the right breast, since this positioning would place the head of the infant lower than the its abdomen. Referring again to FIG. 4, one approach to adjusting the shape of the pillow 10 will be described. As shown in this cross-section, the pillow 10 has a main pillow body 40 and a supplemental wedge-shaped pillow body 42 that when combined give the shape described above. In this preferred embodiment, the supplemental wedge-shaped pillow body 42 is positioned in a pocket 44 on the lower surface 20 of the pillow 10. A similar pocket 46 is provided on the upper surface 18. However, the upper pocket 46 is illustrated as empty and therefore the pocket is collapsed or closed. In order to change the configuration of the pillow 10, the wedge-shaped supplemental pillow body 42 may be removed from the pocket 44 and positioned in the pocket 46. If the supplemental body 42 is moved from the lower pocket 44 to the upper pocket 46, the pillow 10 may then be rotated 180 degrees so as to position it as shown in FIG. 3. In this position, what was originally the upper surface 18 of the pillow 10 becomes the lower surface 18', and what was formerly the lower surface 20 becomes the upper surface 20'. In the positioning and configuration as shown in FIG. 3, the pillow 10 now has a mid portion that slopes downwardly from right to left, whereas in FIG. 4, the mid portion slopes downwardly from left to right. The infant may now be positioned on the pillow in the configuration shown in FIG. 3 so as to nurse from the right breast while resting on the mid portion. The side portions 12 and 14 may be used for nursing in the football-hold position with the pillow configured as shown in either FIG. 3 or 4.

Referring again to FIG. 4, it can be seen that the lower surface 20 of the main pillow body 40 has a shape similar to the upper surface 18 of the main pillow body 40. That is, the mid portion 16 slopes with respect to the central plane H. In the preferred embodiment, the lower surface 20 of the mid portion 16 slopes upwardly from the first end 15 to the second end 17 such that the lower surface at the first end is farther from the plane H than the lower surface of the second end 17 is from the plane. The supplemental pillow body 42 may be said to have a thicker end 46 and a thinner end 48.

As will be clear to those of skill in the art, the pillow 10 may be made in various sizes, shapes, thicknesses, width, and depths. As one example, the pillow may have a side-to-side width of 24 to 48 inches. The mid portion may have a side-to-side width of 10 to 16 inches, with 12 to 14 inches being more typical. A large version may up to two feet wide in the mid portion. The distance between the front edge 22 and the rear 24 of the mid portion 16 may be eight to 18 inches, with 12 inches being one preferred dimension. The side portions 12 and 14 may have a side-to-side width of four to 18 inches, with eight to 14 inches preferred in embodiments where the side portions are used for football-hold nursing. Twelve inches is one usable dimension for the side-to-side width of each side portion. The side portions 12 and 14 preferably extend forwardly beyond the front edge of the mid portion by a distance of four to eight inches. The pillow have a thickness from the upper surface 18 to the lower surface 20 at its thickest area of four to eight inches, with six inches being one usable thickness. At the thinnest portion, where the mid portion surfaces slope towards one another, it is preferred that the thickness be at least one inch and more typically one to four inches. It is in these dimensions, the slope of the sloped upper surface of the mid portion is approximately 10–15 degrees with respect to the central plane. The sloped upper surfaces of the side portions may be in a similar range, though in each case, steeper angles may be used.

Figure 5:
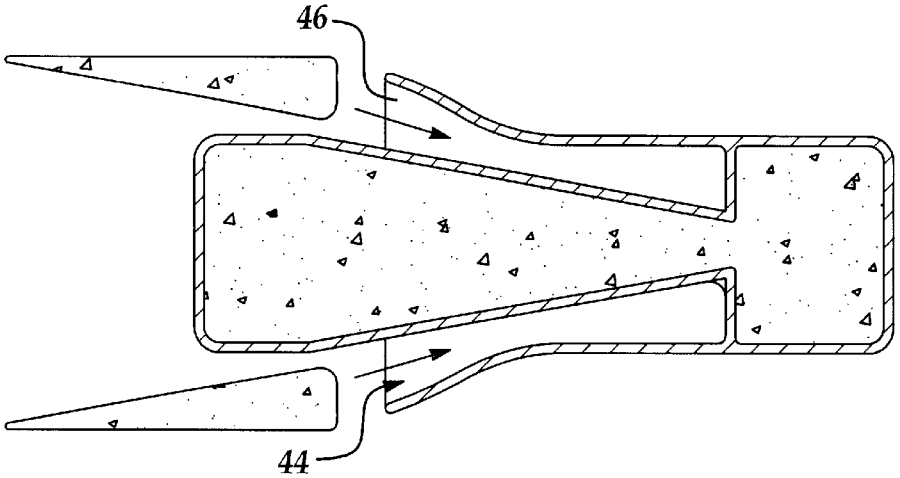
FIG. 5 is a cross-sectional view similar to FIGS. 3 and 4 showing the procedure for positioning a supplemental wedge-shaped pillow into the receiving pockets on the upper or lower surfaces of the main body.

Referring now to FIG. 5, the pillow 10 is shown with the pockets 44 and 46 both open to receive supplemental pillows. As will be clear to those of skill in the art, the same wedge-shape supplemental pillow will fit in either pocket 44 or 46 by turning the supplemental pillow over. According to the preferred embodiment of the present invention, the pillow 10 includes a washable outer cover 50 that is blown full of a poly fiberfill. The cover may be vinyl, a cloth treated with fabric protector, or other materials. Preferably, the cover 50 is filled to a high density so as to create a firm pillow. Alternatively, the pillow may be formed from other materials including foam rubber. Multiple materials may be used, such as a rigid or firm core with a softer outer layer. The pockets 44 and 46 form part of the outer cover 50 and have openings where the higher end of the mid portion joins the adjacent side portion. The pocket is closed on the front and rear sides. Alternatively, the pocket may be accessible in other ways. The supplemental pillow body 42 may be covered or uncovered, and formed of various materials. As another alternative, the wedge-shaped supplemental pillow may be separately covered and attachable to the upper or lower surface of the sloped mid portion in other ways. For example, Velcro® or snaps may be used. As one alternative, a strap may be provided on the front and rear ends of the supplemental pillow with the straps extending around the front and rear edges of the mid portion, either to snaps, Velcro®, or other connectors on the mid portion, or may interconnect with one another to hold the wedge-shaped supplemental pillow in position. An additional outer cover may be provided for covering the main pillow body along with the supplemental pillow. This outer cover may be a removable and washable cover, such as cotton. As a further alternative, the wedge-shaped supplemental pillow may be held in place merely by this extra cover.

There are numerous alternative embodiments of the present invention. As shown in FIG. 5, a supplemental wedge-shaped pillow body may be positioned in the pocket on both the upper and lower surfaces of the pillow. In this configuration, the upper and lower surfaces of the mid portion are generally flat side-to-side. This may be useful for other applications than nursing.

Numerous accessories or extra features may also be added to the pillow 10. For example, a closeable pocket may be provided, such as on the rear edge, for holding lotion, breast pads, or other necessary items. The pocket may zip close to prevent items from falling out. A ring or other attachment may also be provided for holding a burp cloth.

As another alternative embodiment of the present invention, the pillow may be provided without supplemental pillow bodies, such that the mid portion of the pillow has a sloped upper and lower surface. In this configuration, the pillow is positioned such that the side portions rest on the mother's knees. This avoids the necessity of creating a flat mid portion on the lower side of the pillow. As another alternative, the pillow may be created with a more rectangular cutout in the mid portion with a supplemental wedge-shaped pillow being positionable in this cutout to create a mid portion that slopes from one side to the other. The supplemental pillow may then be turned around in the cutout such that the slope is changed. In this configuration, the mid portion may have an upper surface that is lower than the upper surface of the side portions with the supplemental wedge-shaped pillow being positionable in the lowered area.

As further alternatives, the upper and/or lower surfaces of the pillow may be contoured somewhat so as to more comfortably support the infant, or better rest on the lap of the mother. For example, the upper and/or lower surfaces of the side portions 12 and 14 may be somewhat concave side-to-side and/or front-to-back so as to provide a somewhat dish-shaped indentation for receiving the infant, as best shown by the curved lines in FIG. 2. This same concavity may help the pillow rest comfortably atop the legs of the mother. The upper surface of the mid portion may be slightly concave side-to-side and/or front-to-back for similar reasons. Also, the mid portion may slope downwardly from the rear edge 24 to the front edge 22 to tilt the infant towards the mother. As yet other alternatives, the pillow may have one or more safety belts for holding the infant on the pillow and preventing from the infant from rolling off. A pouch or pocket may also be provided with the infant being positioned partially into the pouch. The pillow 10 may also be made somewhat wider than shown so that it may easily rest on the arms of the chair during use and/or provide arm rests for the mother. Alternatively, side supports may extend outwardly from the sides of the pillow 10 for resting on a chair or may include legs so as to turn the pillow into a small table. The pillow may be provided in the various sizes, shapes, and thicknesses so as to suit different users and infants. Alternatively, auxiliary pads may be provided for further adjusting the size or shape of the pillow. The pillow may also have a built-in music box, heater, or vibrator, or other accessories for the comfort of the infant or mother. A privacy tent may be provided so as to cover the nursing infant during use.

As another alternative, the pillow 10 may be configured such that either the front edge 22 or rear edge 24 may be positioned adjacent the abdomen of the mother during use. As will be clear to those of skill in the art, if the pillow of FIG. 2 were to be rotated such that the rear edge 24 is adjacent the abdomen of the user, the sloped mid portion would then slope downwardly from right to left rather than from left to right. As one example, the pillow 10 could have a somewhat H-shaped configuration when viewed from above such that the side portions extend beyond both the front and rear edges of the mid portion. In this configuration, the side portions may be made flatter or may be sloped toward each edge with a higher portion intermediate the front and rear edges. This would position the infant with the head above the abdomen when placed on the side portions in either position. A belt or strap may be provided extending from both the front and rear edges so as to allow interconnection of the pillow with the mother in either position, or a single belt or strap may be provided and configured such that it could be used from either side. As yet another alternative, the pillow may include backpack-style straps, or other support such that it may be used while the mother is standing.

As will be clear to those of skill in the art, numerous other variations on the preferred described embodiments of the present invention may be made without departing from the scope or teaching of the present invention. It is the following claims, including all equivalents, which define the scope of the invention.

I claim:

1. A nursing pillow for supporting an infant on the lap of a user, the pillow comprising:

a main pillow body having a central plane defined therein, with a lower surface below the plane and an opposed upper surface above the plane, the upper and lower surfaces being interconnected by a front edge, a rear edge, and a pair of opposed sides;

the pillow body including:

a mid portion having a first end and a second end, the upper surface of the mid portion sloping continuously downwardly from side to side with respect to the central plane such that the upper surface of the mid portion is farther from the central plane at the first end and closer to the central plane at the second end, the upper surface of the mid portion being configured to receive an infant thereon; and a side portion adjacent the second end of the mid portion, the entire upper surface of the side portion being farther from the central plane than the second end of the mid portion is from the plane such that the upper surface of the pillow body steps upwardly from the second end of the mid portion to the side portion;

wherein the midportion has a side to side width greater than a side to side width of the side portion.

2. The nursing pillow according to claim 1, wherein the pillow body further includes a second side portion adjacent the first end of the mid portion.

3. The nursing pillow according to claim 2, wherein the front edge of the side portions extend forwardly beyond the front edge of the mid portion such that the pillow body has a generally concave front edge.

4. The nursing pillow according to claim 1, wherein the upper surface of the side portion slopes downwardly from the rear edge to the front edge with respect to the central plane.

5. The nursing pillow according to claim 1, wherein the sloped upper surface of the mid portion is generally planar.

6. The nursing pillow according to claim 1, wherein the sloped upper surface of the mid portion is generally concave.

7. The nursing pillow according to claim 1, wherein the upper surface of the side portion is generally concave.

8. The nursing pillow according to claim 1, wherein the lower surface of the mid portion slopes upwardly from side to side relative to the central plane such that the lower surface of the mid portion is farther from the central plane at the first end and closer to the central plane at the second end.

9. The nursing pillow according to claim 8, further comprising a supplemental pillow body having a generally wedged shape with a thicker end and thinner end, the supplemental pillow body being engagable with the lower surface of the main pillow body with the thicker end adjacent the second end and the thinner end adjacent the first end such that the combined supplemental pillow and main pillow bodies have a generally flat lower surface.

10. The nursing pillow according to claim 9, wherein the supplemental pillow body is further engagable with the upper surface of the main pillow body with the thicker end adjacent the second end and the thinner end adjacent the first end such that the combined supplemental pillow and main pillow bodies have a generally flat upper surface.

11. The nursing pillow according to claim 10, wherein the upper and lower surfaces of the mid portion have pockets defined thereon for receiving the supplemental pillow body.

12. A nursing pillow assembly for supporting an infant on the lap of a user, the assembly comprising:

a main body having a front user edge, a rear edge and a pair of opposed sides extending between the front and rear edges, the main body having an upper surface that is sloped from side to side and a lower surface that is sloped from side to side, the main body having a side to side width sufficient to receive an infant lengthwise entirely thereon; and a removable portion that can be mated with the upper or lower surface to create a generally flat surface, a pair of side portions joined to opposite sides of the main portion, each of the side portions extending forwardly beyond the front edge of the main portion.

13. The nursing pillow according to claim 12, wherein the removable portion is generally wedge shaped.

14. The nursing pillow according to claim 12, wherein the upper surface of the side portions slopes downwardly from the rear edge to the front edge of the pillow assembly.

15. The nursing pillow according to claim 12, wherein the main body includes pockets defined on the upper and lower surfaces for receiving the removable portion.

16. A nursing pillow for supporting an infant on the lap of a user, the pillow having a front user edge, a rear edge and a pair of opposed sides extending between the front and rear edges, the nursing pillow comprising:

a mid portion having an upper surface that is sloped downwardly from side to side wherein the mid portion has a lower surface that is sloped upwardly from side to side, the pillow further comprising a removable portion that mates with the lower surface of the mid portion, the removable portion being generally wedge shaped such that when the removable portion mates with the lower surface of the mid portion the pillow has a generally flat lower surface; and a side portion joined to the mid portion, the side portion having an upper surface that is sloped downwardly from the rear edge to the user edge of the pillow.

17. The nursing pillow according to claim 16, further comprising a second side portion joined to the mid portion, the second side portion having an upper surface that is sloped downwardly from the rear edge to the user edge of the pillow.

18. A nursing pillow for supporting an infant on the lap of a user, the pillow comprising:

a main pillow body having a lower surface and an opposed upper surface interconnected by a front edge, a rear edge, and a pair of opposed sides;

the pillow body having a pair of side portions and a mid portion disposed between the side portions;

the upper surface of the mid portion being downwardly sloped from side to side such that the upper surface of the mid portion has a lower end and a higher end;

the lower surface of the mid portion being upwardly sloped from side to side such that the lower surface of the mid portion has a higher end and a lower end; and a supplemental pillow body having a wedge shape with a thicker end and a thinner end, the supplemental pillow body being engagable with the lower surface of the main pillow body with the thicker end adjacent the higher end and the thinner end adjacent the lower end such that the combined supplemental pillow and main pillow bodies have a generally flat lower surface.

19. The nursing pillow according to claim 18, wherein the upper surface of the side portions slopes downwardly from the rear edge to the front edge.

20. The nursing pillow according to claim 18, wherein the front edge of the side portions extend forwardly beyond the front edge of the mid portion such that the front edge of the main pillow body is concave.

21. The nursing pillow according to claim 18, wherein the upper surface steps upwardly from the lower end of the mid portion to the upper surface of the adjacent side portion.

* * * * *